US005674124A

United States Patent [19]

Davis

[11] Patent Number: 5,674,124

[45] Date of Patent: Oct. 7, 1997

[54] AIR REGISTER WITH PIVOTING AIR DEFLECTOR

[76] Inventor: Reed A. Davis, 19 Elice Cir., Sedona, Ariz. 86336

[21] Appl. No.: 386,112

[22] Filed: Feb. 8, 1995

[51] Int. Cl.[6] ..... F24F 13/072

[52] U.S. Cl. ..... 454/290; 454/289; 454/306; 454/316; 454/326

[58] Field of Search ..... 454/284, 289, 454/290, 306, 307, 309, 316, 326, 332, 155

[56] References Cited

U.S. PATENT DOCUMENTS

| | | | |
|---|---|---|---|
| 1,691,285 | 11/1928 | Helms | 454/290 |
| 2,088,643 | 8/1937 | Eckenroth | 454/327 |
| 3,628,441 | 12/1971 | Ardussi . | |
| 3,921,507 | 11/1975 | Condet et al. | 454/155 |
| 4,602,556 | 7/1986 | Gladden . | |
| 4,633,770 | 1/1987 | Taylor et al. | 454/316 X |
| 5,230,657 | 7/1993 | Opoka | 454/289 |
| 5,232,403 | 8/1993 | Marotta | 454/289 |

FOREIGN PATENT DOCUMENTS

| | | | |
|---|---|---|---|
| 247446 | 11/1991 | Japan | 454/316 |

*Primary Examiner*—Harold Joyce

*Attorney, Agent, or Firm*—Craine & Jackson, P.S.

[57] ABSTRACT

This is an air register having a grille member pivotally attached to the register housing. A spring is disposed between the grille member and the register housing which biases the grille member in an upward, diagonal extended position from the central passageway formed inside the register housing. During use, the grille member is automatically disposed in an upward, diagonal extended position which deflects the exiting air at an angle into the room. When a downward force is applied to the top surface of the grille member, say by a person's foot, the grille member is able to pivot downward around one edge into a retracted position inside the central passageway. The air register also includes a pair of overlapping plates controlled by a control knob which control the amount of air exiting from the air register. The air register also includes optional stop bars designed to allow the user to selectively lock the grille member in the retracted position or adjust the upward, diagonal extended position of the grille member.

12 Claims, 2 Drawing Sheets

AIR REGISTER WITH PIVOTING AIR DEFLECTOR

BACKGROUND OF THE INVENTION

1. Field of the Invention

This invention relates to forced air registers, and more particularly to air registers having means for deflecting air into the room.

2. Description of the Related Art

It is generally acknowledged in the heating and air conditioning industry that deflecting forced air at a desired angle into a room away may be desirable for efficiency and economical reasons. One common method used to deflect forced air at a desired angle into a room is by placing a rigid curved or angled deflecting device over the vents of the air register. One drawback, however, with such devices is that they are unattractive and may be kicked or stepped on.

SUMMARY OF THE INVENTION

It is an object of the present invention to provide an air register having a built-in means for deflecting air at a desired direction into the room.

It is another object of the present invention to provide such an air register in which the means for deflecting air into the room may be retracted into a less visible and protected position to prevent tripping or breakage.

It is a still further object of the present invention to provide such an air register in which the direction of deflected air may be selectively controlled by the user.

The invention disclosed herein is designed to meet these and other objects which shall become apparent comprises an air register with a grille member pivotally attached along one edge inside the central passageway of the air register's housing. The grille member is capable of being automatically disposed at an upward, diagonal extended angle from the central passageway to deflect forced air delivered to the air register at a desired angle into the room. In the preferred embodiment, the grille member has a plurality of vents disposed at an angle so that the forced air exits substantially perpendicular to the central passageway's longitudinal axis. When the air register is placed on a floor heating duct, the forced air exists the air register substantially horizontally, away from any walls or curtains. A biasing means is used to automatically bias the grille member in the upward, diagonally extended position. The biasing means is sufficiently resilient so that the grille member may rotate downward into a protected, retracted position inside the air register when hit or stepped on. Optional stop means is also provided which enable the grille member to be locked in the retracted position or disposed at a selected upward, diagonally extended position from the central passageway.

DESCRIPTION OF THE PREFERRED EMBODIMENT(S)

Figure 1:
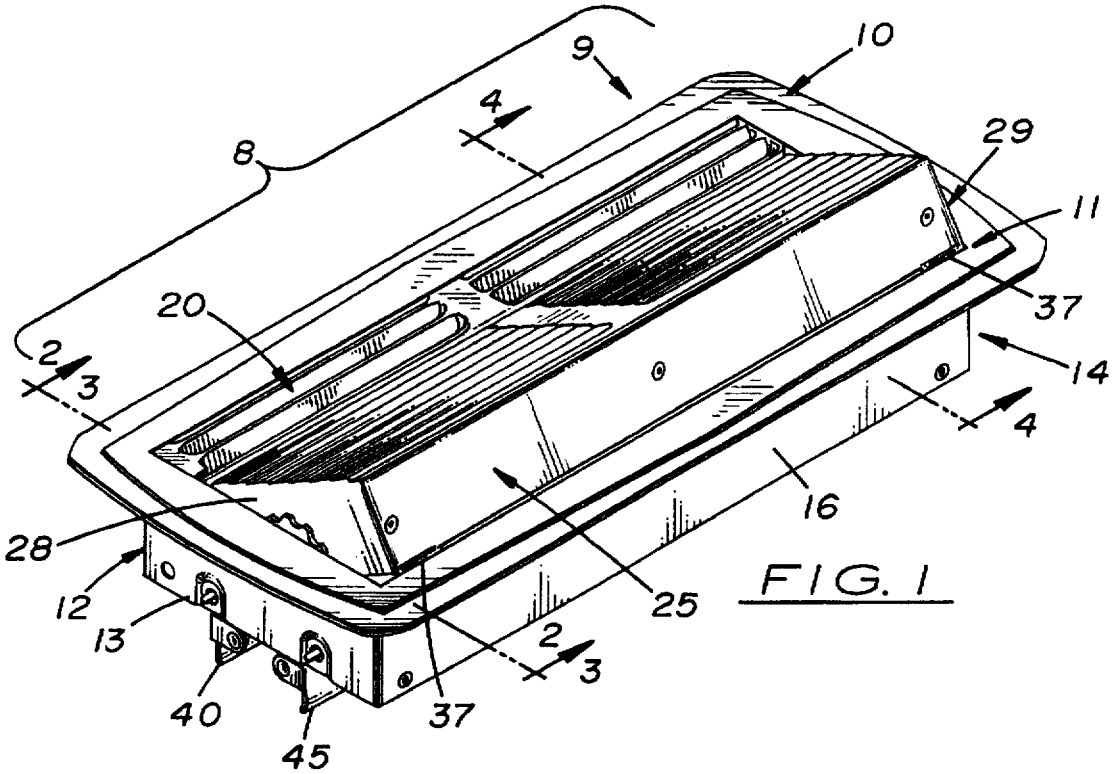
FIG. 1 is a perspective view of one embodiment of the invention.

Shown in the accompanying FIGS. 1–5, there is shown an improved air register, generally indicated by the reference number 8, having a grille member 25 capable of deflecting forced air delivered to the air register 8 into the room at a desired angle.

The air register 8 comprises a register housing 9 including an upper, planar outer frame member 10 attached to the upward extending edges of a box structure 12. The box structure 12 is aligned perpendicular and attached to the lower surface of the outer frame member 10. The outer frame member 10 is longer and wider than the box structure 12 thereby enabling the air register 8 to be supported on a flat surface surrounding the opening of a heating duct. The box structure 12 has two end walls 13, 14 and two side walls 15, 16 which form a rectangular-shaped structure capable of being inserted into the opening of the heating duct. The central portions of the outer frame member 10 and box structure 12 are opened thereby forming a continuous central passageway 22 in the register housing 9 through which forced air delivered to the air register 8 may travel. In the preferred embodiment, a narrow grille member 20 is longitudinally aligned and fixed inside the central passageway 22 and with its top surface approximately level with the top surface of the outer frame member 10.

Figure 2:
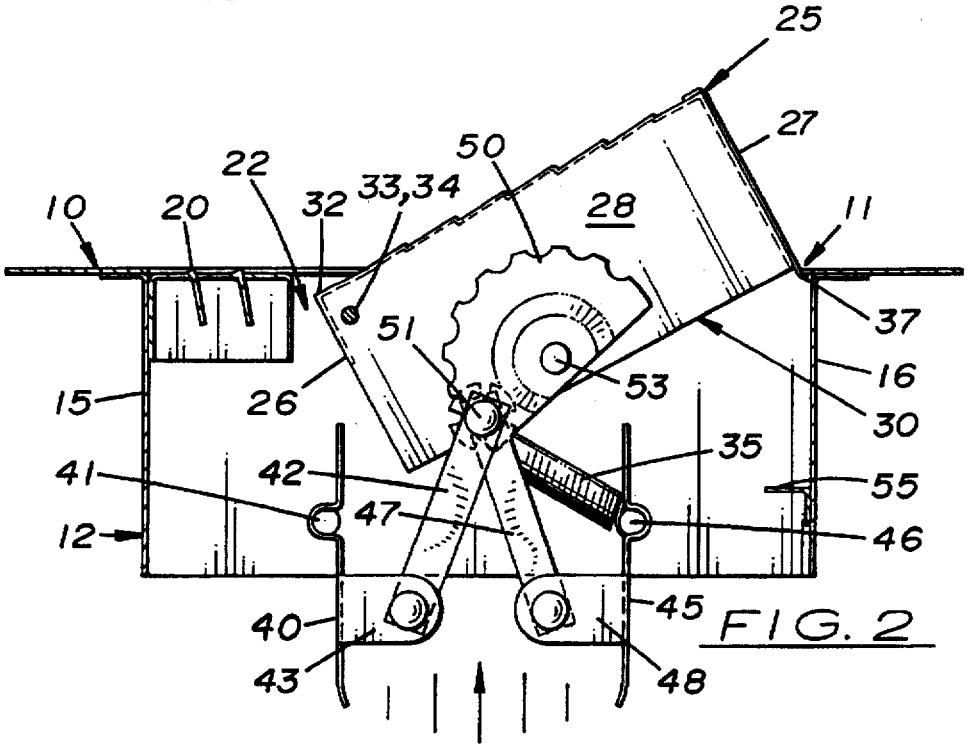
FIG. 2 is a sectional, side elevational view taken along line 2—2 in FIG. 1 showing the lower plates in an opened position.
Figure 3:
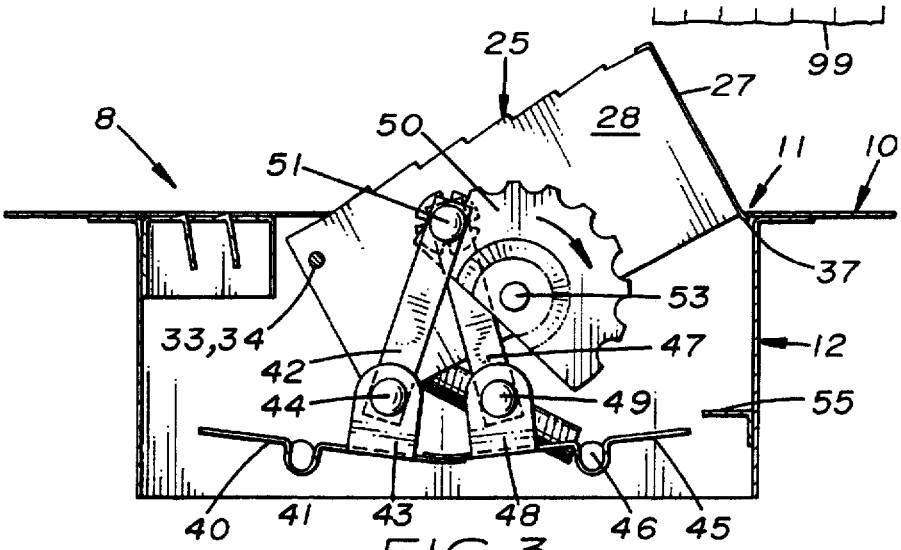
FIG. 3 is a sectional, side elevational view taken along line 3—3 in FIG. 1 showing the lower plates in a closed position.
Figure 4:
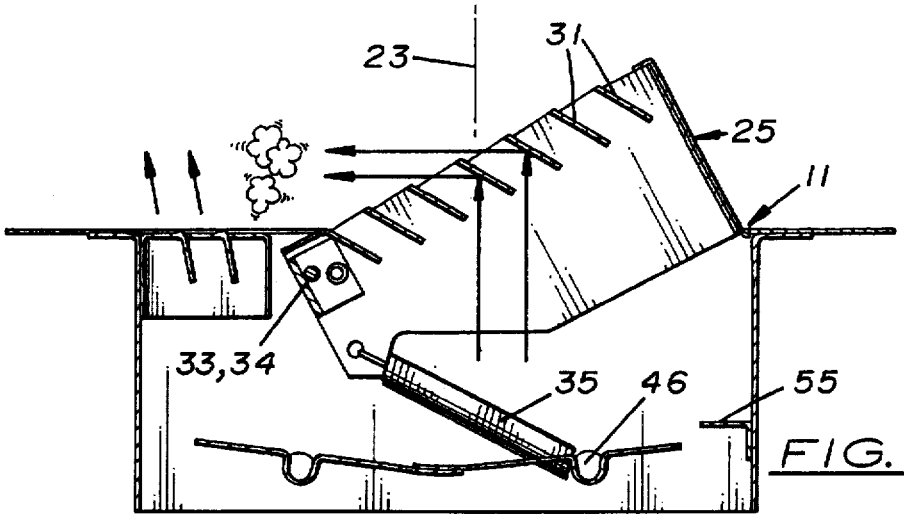
FIG. 4 is a sectional, side elevational view taken along line 4—4 in FIG. 1 showing the biasing means used to hold the grille member at an angle.

As shown in FIGS. 1–4, disposed inside the central passageway 22 adjacent to the narrow grille member 20 is a larger grille member 25. The larger grille member 25 is a rectangular-shaped box structure with parallel front and rear lateral surfaces 26, 27, respectively, and parallel first and second end surfaces 28, 29. The grille member 25 has a bottom opening 30 and a top surface which comprises a plurality of angled, traversely aligned vents 31. In the preferred embodiment, the vents 31 are disposed at a sufficient angle so that the forced air exits perpendicularly from the central passageway's longitudinal axis 23, as shown in FIG. 4, when the grille member 25 is disposed in an upward extended position. The outer shape of the grille member 25 is also complimentary with the outer shape of the portion of the central passageway 22 adjacent to the fixed grille member 20 so that substantially all of the forced air delivered to the air register 8 exits either through the grille member 25 and the adjacent narrow grille member 20.

Figure 5:
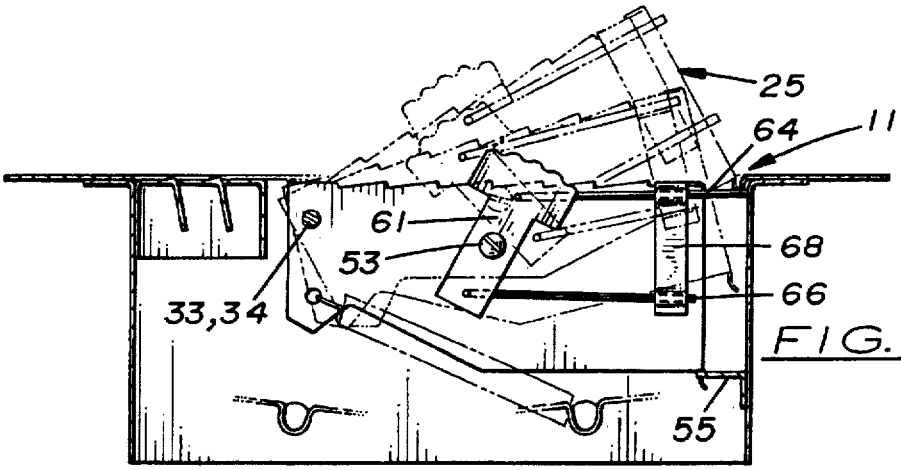
FIG. 5 is a sectional, side elevational view showing an optional stop and adjustment means disposed between the grille member and the air register's box structure.

The grille member 25 is pivotally attached to the end walls 13, 14 of the box structure 12 via two pivotal connectors 33, 34. The pivoting connectors 33, 34 are located near the upper front corner on the grille member's first and second end surfaces 28, 29 so that the grille member 25 may pivot inside the air register 8 around its upper front edge 32 as shown in FIG. 5. In the preferred embodiment, the height and rotation of the grille member 25 is limited so that the upper edge of the grille member 25 misses the lower edge of a curtain 99 as shown in FIG. 3.

As shown in FIG. 4, a spring 35 is disposed between the lower edge of the front lateral surface 26 on the grille member 25 and the pivoting connector 46 for the lower plate 45 discussed further below. During operation, the spring 35 pulls the front lower edge downward thereby causing the grille member 25 to rotate around the pivoting connectors 33, 34 into an upward, diagonally extended position. The spring 35 has sufficient tension so that the grille member 25 is automatically biased around the pivoting connectors 33, 34. The spring 35 also is sufficiently elastic so that the grille member 25 may be forcibly rotated in the opposite direction into a protected, retracted position inside the box structure 12. When the grille member 25 is disposed in the retracted position, forced air delivered to the air register 8 exits diagonally from the outer frame member 10. In other embodiments, spring 35 may be replaced by a spring clip (not shown).

Located on the lower portion of the box structure 12 are two longitudinally aligned lower plates 40, 45. The lower plates 40, 45 are spaced apart and disposed between the end walls 13, 14 of the box structure 12. The lower plates 40, 45 are pivotally connected to the end walls 13, 14 via two pivotal connectors 41, 46, respectively. During operation, the pivotal connectors 41, 46 enable the lower plates 40, 45 to rotate so that their inside edges overlap to close off the box structure's lower opening thus preventing forced air from entering the air register 8. In the preferred embodiment, each plate 40, 45 has an inward facing, angled surface 43, 48, respectively, formed at one end. Pivoting arms 42, 47 are attached at one end to the angled surfaces 43, 48, respectively, via second pivoting connectors 44, 49. The opposite ends of the pivoting arms 42, 47 are attached to a single pivoting connecter 51 attached near the peripheral edge of the turn knob 50. The turn knob 50 is attached to the end wall 13 of the box structure 12 via a main pivoting connector 53. When the turn knob 50 is rotated, the pivoting arms 42, 47 forcibly rotate the plates 40, 45 between an opened and closed positions as shown in FIGS. 2 and 3.

Attached or formed near the lower edge of the rear lateral surface 27 of the grille member 25 is a lip structure 37 which acts as an upward limiting stop means. The lip structure 37 extends in a rearward direction from the rear lateral surface 27 and makes contact with the rear edge 11 of the outer frame member 10 when the grille member 25 is rotated into the upward, angled position. During operation when the grille member 25 pivots upward, its upward rotation is limited to approximately 45 degrees.

Attached or formed on or near to the inside surface of the rear side wall 16 of the box structure 12 near its lower edge is a downward limiting stop surface 55. The stop surface 55 is an L-shaped structure having one leg that extends forward into the central passageway 22 thereby limiting downward rotation of the grille member 25 as shown in FIG. 5. In the preferred embodiment, the stop surface 55 is positioned on the inside surface of the rear side wall 16 so that when the grille member 25 is in a retracted position, the top surface of the grille member 25 is level with the top surface of the outer frame member 10.

Also as shown in FIG. 5, is an optional, combined locking and adjustment means is provided which enables the grille member 25 to be locked in the retracted position or in a selected extended, diagonal position relative to the top surface of the air register 8. In the embodiment shown, the combined locking and adjustment means comprises two, spaced apart locking arms 64, 66, respectively, attached to the turn knob 61. The locking arms 64, 66 are aligned in a parallel manner and attached at one end to the turn knob 61 on opposite sides of the main pivoting connector 53. An interconnecting strap 68 is perpendicularly aligned over the two locking arms 64, 66 near the distal ends. The locking arms 64, 66 are attached to the turn knob 61 and have sufficient length so that when the turn knob 61 is rotated in a clockwise direction, the upper locking arm 64 extends under the rear edge 11 on the outer frame member 10 to lock the grille member 25 in a retracted position inside the air register 8. When the turn knob 61 is partially rotated in a counter-clockwise direction, the upper locking arm 64 disengages the rear edge 11. The lower locking arm extends outward to the rear edge 11 thereby disposing the grille member 25 in a partially extended position. When the turn knob 61 is fully rotated in a counter-clockwise direction, both the upper and lower locking arms 64, 66, respectively, disengage the rear edge 11 thereby enabling the grille member 25 to fully extend from the air register 8.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An air register, comprising:

a. a register housing, said register housing having an outer frame member with a lower box structure attached thereto, said register housing having a continuous central passageway formed therein;

b. a grille member disposed inside said central passageway, said grille member being pivotally attached along one edge to said register housing enabling said grille member to pivot between an upward, diagonally extended position and a fully retracted position within said central passageway;

c. a biasing means disposed between said register housing and said grille member, said biasing means capable of automatically disposing said grille member in an upward, diagonally extended position from said central passageway;

d. an upward limiting stop means capable of limiting the upward rotation of said grille member in said central passageway, and;

e. a downward limiting stop means capable of limiting the downward rotation and locking said grille member in a fully retracted position in said central passageway.

2. An air register as cited in claim 1, further including two lower plates disposed inside said register housing, said lower plates capable of being selectively moved between opened and closed positions to control the amount of air entering said air register.

3. An air register as cited in claim 2, wherein said biasing means is a spring.

4. An air register as cited in claim 2 wherein said upward limiting stop means is a lip structure formed on said grille member capable of limiting the upward rotation of said grille member on said register housing.

5. An air register as cited in claim 4 wherein said downward limiting stop means is a stop surface attached inside said register housing capable of limiting the downward rotation of said grille member on said register housing.

6. An air register as cited in claim 5, further including a combination stop and adjustment means disposed between said grille member and said register housing to selectively adjust and lock said grille member on said register housing.

7. An air register as cited in claim 6, further including a plurality of vents formed on said grille member capable of deflecting the forced air exiting said grille member substantially perpendicular to said central passageway.

8. An air register, comprising:

a. a register housing, said register housing having an outer frame member and a box structure attached thereto, said register housing having a continuous central passageway formed therein;

b. a grille member capable of being disposed inside said central passageway, said grille member being pivotally attached along one edge thereof enabling said grille member to pivot between an upward, diagonally extended position and a fully retracted position within said central passageway, said grille member further including a lip structure attached to said grille member which limits the upward rotation of said grille member on said register housing;

c. a stop surface attached to said register housing capable of limiting and locking said grille member in a retracted position in said register housing, and;

d. a spring disposed between said register housing and said grille member, said spring capable of automatically disposing said grille member in an upward, diagonally extended position from said central passageway.

9. An air register as cited in claim 8, further including a combination stop and adjustment means disposed between said grille member and said register housing to selectively adjust and lock said grille member on said register housing.

10. An air register as cited in claim 9, further including two lower plates pivotally attached and longitudinally aligned inside said register housing, said lower plates capable of being selectively rotated between opened and closed positions to control the amount of air entering said air register.

11. An air register, comprising:

a. a register housing, said register housing having an outer frame member attached to a box structure, said register housing having a continuous central passageway formed therein;

b. a grille member capable of being disposed inside said central passageway, said grille member being pivotally attached along one edge thereof enabling said grille member to pivot between an upward, diagonally extended position and a fully retracted position within said central passageway, said grille member further including a lip structure attached to said grille member limiting the upward rotation of said grille member on said register housing;

c. a stop surface attached to said register housing capable of limiting the downward rotation of said grille member on said register housing, and;

d. a spring disposed between said register housing and said grille member, said spring capable of disposing said grille member in an upward, diagonally extended position from said central passageway.

12. An air register as cited in claim 11 further including a combination stop and adjustment means disposed between said grille member and said register housing to selectively adjust and lock said grille member on said register housing.

* * * * *